US006588035B2

(12) United States Patent
Le Duc et al.

(10) Patent No.: US 6,588,035 B2
(45) Date of Patent: Jul. 8, 2003

(54) MATTRESS SUPPORT SYSTEM

(75) Inventors: Thomas C. Le Duc, Salt Lake City, UT (US); Van Wayman, Salt Lake City, UT (US)

(73) Assignee: The Spring Air Company, Elk Grove, IL (US)

( * ) Notice: Subject to any disclaimer, the term of this patent is extended or adjusted under 35 U.S.C. 154(b) by 0 days.

(21) Appl. No.: 09/835,706

(22) Filed: Apr. 16, 2001

(65) Prior Publication Data

US 2002/0148043 A1 Oct. 17, 2002

(51) Int. Cl.[7] ..... A47C 23/053
(52) U.S. Cl. ..... 5/247; 5/246; 5/255; 267/95
(58) Field of Search ..... 5/247, 239, 246, 5/255, 258, 717, 719, 721; 267/95, 86, 100, 103

(56) References Cited

U.S. PATENT DOCUMENTS

| | | | | | |
|---|---|---|---|---|---|
| 73,755 | A | | 1/1868 | Rear | 5/248 |
| 747,002 | A | * | 12/1903 | Shaiffer | 5/247 |
| 754,260 | A | * | 3/1904 | Venable, Sr. | 5/247 |
| 1,597,205 | A | * | 8/1926 | Lowell | 5/246 |
| 2,305,530 | A | * | 12/1942 | Hopkes | 5/246 |
| 2,360,966 | A | * | 10/1944 | Mouw | 5/246 |
| 2,454,964 | A | * | 11/1948 | Elder | 5/247 |
| 2,454,965 | A | * | 11/1948 | Elder | 5/247 |
| 2,494,432 | A | * | 1/1950 | Elder | 5/247 |
| 2,578,331 | A | * | 12/1951 | White | 5/247 |
| 3,559,219 | A | * | 2/1971 | Molt | 5/247 |
| 3,560,049 | A | * | 2/1971 | Burton | 5/255 |
| 3,618,146 | A | | 11/1971 | Ferdinand | 5/717 |
| 4,067,076 | A | | 1/1978 | Krier | 5/717 |
| 4,100,631 | A | | 7/1978 | Slone | 5/239 |
| 4,462,129 | A | | 7/1984 | Brannock | 5/717 |
| 4,886,250 | A | | 12/1989 | Lucas | 267/95 |
| 5,188,343 | A | * | 2/1993 | Galea | 5/255 X |
| 5,210,890 | A | | 5/1993 | Hagglund | 5/239 |
| 5,537,699 | A | | 7/1996 | Bonaddio et al. | 5/739 |
| 5,724,686 | A | | 3/1998 | Neal | 5/717 |
| 6,154,908 | A | | 12/2000 | Wells | 5/720 |
| 2002/0148043 | A1 | * | 10/2002 | Le Duc et al. | 5/200.1 |

FOREIGN PATENT DOCUMENTS

| | | | | |
|---|---|---|---|---|
| FR | 512970 | * | 8/1952 | 5/247 |
| GB | 196356 | * | 4/1923 | 5/246 |
| GB | 512725 | * | 9/1939 | 5/247 |
| GB | 802580 | * | 10/1958 | 267/95 |

* cited by examiner

*Primary Examiner*—Robert G. Santos
(74) *Attorney, Agent, or Firm*—Schiff Hardin & Waite

(57) ABSTRACT

A mattress support system for a bed, comprising a base section, a wire support section, and an upper section. The upper section has one or more substantially rigid edge frame members incorporated therein for increased mattress edge support. The edge frame members may further comprise extensions of the upper section, such that the upper section is wider and/or longer than the base section, so that the mattress support system may be supported by a frame which corresponds to the size of the base section, while fully supporting a mattress which corresponds to the larger size of the upper section.

19 Claims, 2 Drawing Sheets

MATTRESS SUPPORT SYSTEM

BACKGROUND OF THE INVENTION

1. Field of the Invention

This invention relates to bedding support structures. More particularly, the present invention relates to a mattress support system which provides a rigid edge support, and also allows a mattress of one size to be supported by a mattress support which fits onto a frame of a smaller size.

2. Discussion of the Art

Box springs are a common type of mattress support. The use of a box spring to support a bed mattress is very old and well known. A typical box spring includes a substantially rigid rectangular base frame—frequently made of attached wood slats—with a plurality of spring elements extending upward therefrom. The spring elements may be coil springs or other types of wire supports. Atop the spring elements is a flexible wire top frame or mat having the same outer dimensions as the base frame, which defines the top of the box spring. The framework consisting of the base frame, spring elements, and top frame is then covered or wrapped with fabric, taking on a form and appearance similar to that of a mattress, though usually without substantial foam or other padding. The box spring is then placed upon a bed frame, and a mattress having the same approximate size as the box spring is placed atop the box spring, forming a bed.

The purpose of a box spring is to resiliently support the mattress, providing more cushion for one lying atop the mattress, and also to extend the life of the mattress by giving it full support along its entire lower surface. However, because of the flexible wire top frame and spring elements, the edges of typical box springs may not provide desirable support for the edge of the mattress. When a person sits upon the edge of the mattress, the edge of the mattress presses down against the box spring fabric cover and wraps around the wire elements, accelerating wear of the mattress and of the box spring fabric cover. Many users also prefer a more rigid edge support, and find an extremely flexible edge to be undesirable.

Additionally, a typical box spring cannot fully support a mattress of a larger size without the provision of an additional component, because a larger size mattress would hang over the edge of the box spring. Without adequate support beneath, the edges of the mattress become unuseable, and the mattress also wears out faster. Currently, a bed owner who desires to move up to a larger size mattress can insert an extension panel or equivalent additional piece of bed support equipment between the mattress and box spring to support the additional size. Alternatively, they must purchase not only a matching larger box spring, but a new and larger bed frame, at significant expense. Neither of these solutions are economical or desirable in many situations.

SUMMARY

The inventors have developed a mattress support system with a more rigid edge frame for supporting the edge of a mattress, and with edge extensions for supporting a larger mattress. In an illustrative embodiment, the invention provides a mattress support system for a bed, comprising a base section and an upper section. The upper section has one or more edge frame members incorporated therein, which are supported on the base section for firm mattress edge support.

In accordance with a more detailed aspect of the present invention, the edge frame members may further comprise extensions of the upper section, such that the upper section is wider or longer, or both, than the base section, so that the mattress support system may be supported by a frame which corresponds to the smaller size of the base section, while fully supporting a mattress which corresponds to the larger size of the upper section.

The invention thus allows one having a bed frame of a particular size to use a larger mattress without having to purchase additional bed frame components. It also provides firm support for the edge of the mattress. Additional features and advantages of the invention will be apparent from the detailed description which follows, taken in conjunction with the accompanying drawings, which together illustrate, by way of example, features of the invention.

DETAILED DESCRIPTION

Figure 1:
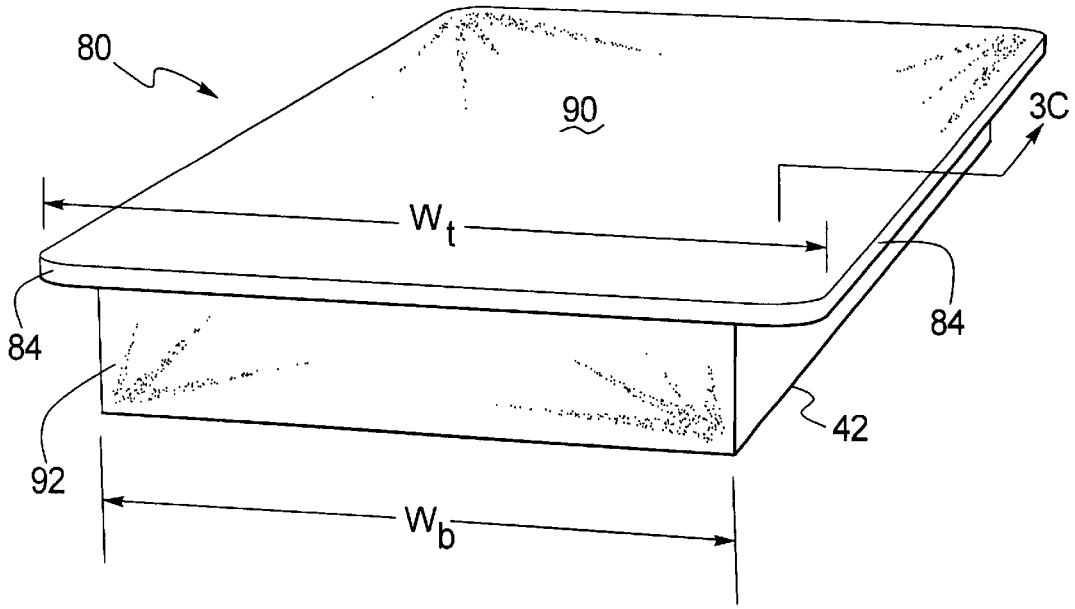
FIG. 1 is a pictorial view of a mattress support system in accordance with the present invention, incorporating rigid edge frame extension members.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
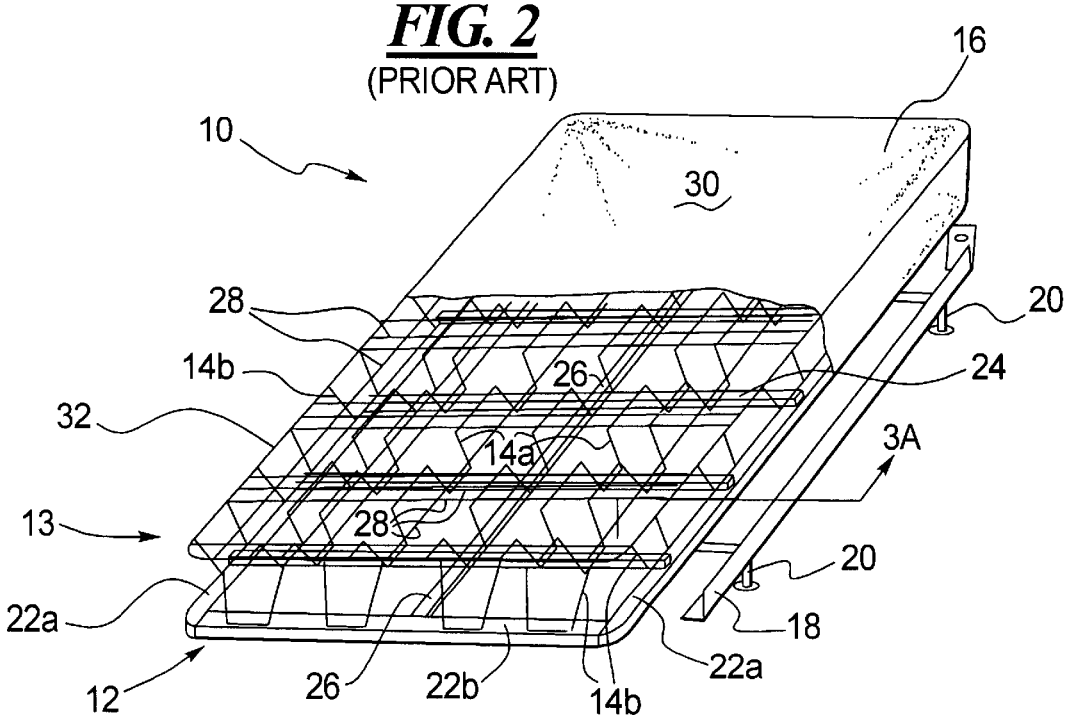
FIG. 2 (PRIOR ART)
FIG. 2 is a pictorial view of a conventional box spring with a portion of the fabric cover cut away to reveal the inner structure.
Figure 3A:
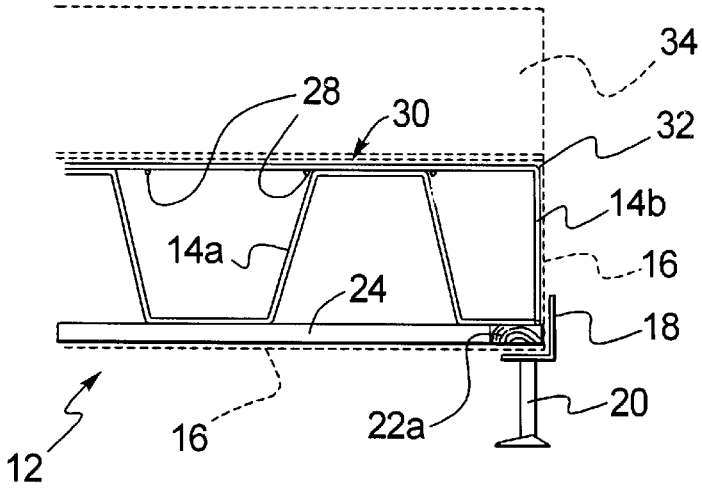
FIG. 3A (PRIOR ART)
FIG. 3A is a partial cross-sectional view, taken along section line 3A in FIG. 2, of the edge of a conventional box spring.

Referring to FIGS. 2 and 3A, a conventional box spring 10 for supporting a mattress 34 in FIG. 3A generally consists of a base section 12, upon which is attached a wire support section 14 comprising an array of interconnected wire elements, which support an upper section 13, all encased within a fabric cover 16. The box spring 10 in turn is usually supported by a bed frame 18, typically made of wood or metal, having feet 20 which rest upon the floor.

The base 12 generally consists of a rectangular perimeter frame 22, usually having two long sides 22*a* and two short sides 22*b*, with a plurality of transverse members 24 extending perpendicularly between the long sides 22*a*, for supporting the spring elements. A longitudinal reinforcing member 26 may also be provided approximately in the middle of the base transverse members to provide additional strength to the base frame. The various members of the base 12 may be made from a variety of materials, such as wood or plastic, though wood is commonly used. Because the box spring must support the weight of a mattress and one or more users, it is preferable that the base be comprised of members that are both strong and lightweight.

The upper section 13 comprises an intermediate wire support surface, usually a grid of longitudinal and transverse wires 28, and an edge wire 32. These are supported on the wire support section 14, and in turn support the top cover 30 of the box spring, on which the mattress 34 is positioned, in a manner well known. The wire support section generally comprises interior resilient wire elements 14*a*, and perimeter resilient wire elements 14*b*. The grid of wire support members 28 and edge wire 32 are supported around the edge of the box spring by the perimeter wire elements 14*b*, and across the interior of the box spring by the interior resilient wire elements 14*a*. As shown most clearly in FIG. 3A, the underside of the mattress is supported at its edges by the edge wire 32, with underlying support from the surrounding perimeter resilient wire elements 14*b*.

Figure 3B:
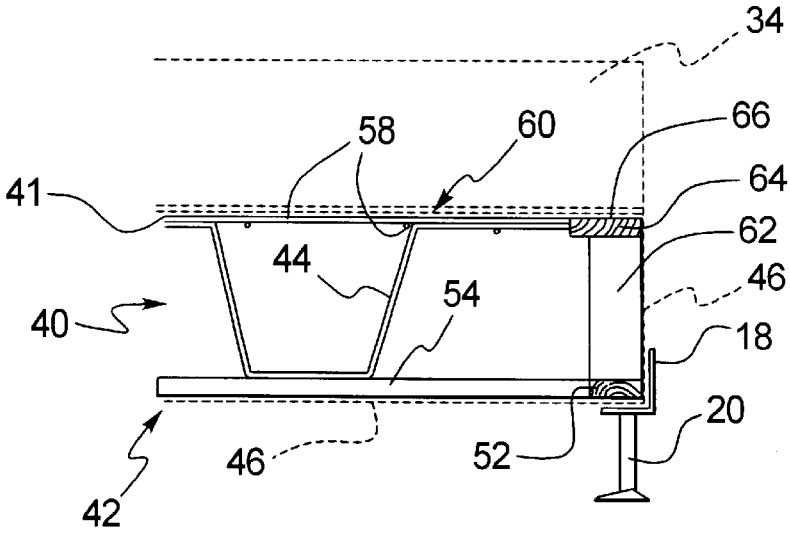
FIG. 3B is a partial cross-sectional view of an edge of a mattress support system in accordance with the present invention, having a substantially rigid edge frame which is supported on the base section.
Figure 3C:
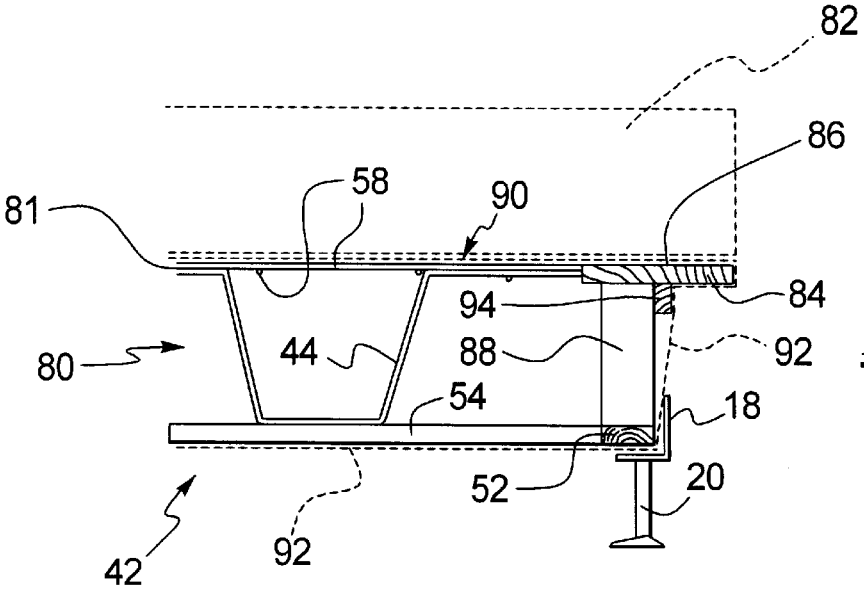
FIG. 3C is a partial cross-sectional view, taken along section line 3C in FIG. 1, of an edge of a mattress support system having a rigid edge frame extension member.

Referring to FIGS. 1, 3B, and 3C, the inventors have devised a mattress support system which appears to have surprising results. Specifically, rather than having an edge wire in the upper section, which provides the primary edge support for the mattress, the inventors have noted significant advantages of a substantially rigid edge frame which is disposed in one or more edges of the mattress support system. Viewing FIG. 3B, an improved mattress support system 40 generally comprises a base frame or base section 42, which supports a wire support section 44 comprising an array of interconnected resilient wire elements, encased within a fabric cover 46, and supported by a bed frame 18, having feet 20. As in the prior art, the base 42 includes a perimeter frame 52, and transverse members 54. Also as with the prior art, the base frame 42 may be made from a variety of materials, including wood, plastic, or other materials.

The resilient wire elements 44 support an upper section 41, which includes an intermediate wire support surface comprising an upper grid of wires 58 which support a top cover 60, on which a mattress 34 (shown in outline) would be positioned. Unlike the prior art, however, support along the edge of the upper section 41 is not provided by an edge wire, but rather by a substantially rigid edge frame 64, supported on a substantially rigid upstanding support 62. The edge frame 64 and upstanding supports 62 are preferably made of wood, but other materials may be used, such as plastics, composites, or other suitably strong and lightweight materials.

The edge frame 64 has a substantially planar upper support surface 66, which may vary in width, such as from 3 inches to 10 inches wide. The rigid edge frame may extend around the entire perimeter of the mattress support system, or may be provided only on one side, both long sides, the short ends, just the foot, or any combination of sides as desired.

This configuration both makes the edge of the bed more supportive, and also helps extend the life of the mattress. Because the mattress 34 rests at its edges on the wide top surface 66 of the edge frame 64, rather than the small top surface of an edge wire, there is a substantial reduction in wear of the mattress and an improvement in support to the mattress for situations such as where persons sit at the edge of the bed. This is a significant problem because the edge portion of the mattress represents a weaker area which traditionally has not provided strong support. The invention thus reduces the deflection of the edge of the mattress and mattress support system, thereby more firmly supporting the user and reducing wear on the bed components.

As shown in FIG. 3B, the mattress support system may comprise an edge frame 64 which merely takes the place of perimeter wire elements (14*b* in FIGS. 2 and 3A) and a perimeter wire (32 in FIGS. 2 and 3A), such that the overall shape of the mattress support system is the same as a conventional box spring. However, as shown in FIGS. 1 and 3C, an alternative mattress support system 80 may comprise an upper section 81 with an edge frame extension member 84 which has a wide top surface 86 and extends beyond the perimeter of the base frame 42. The edge frame extension member 84 is substantially rigidly supported by a plurality of upright supports 88, which in turn are supported on the perimeter frame 52. The edge frame extension member 84 and the upright supports 88 may be formed of wood, plastic, or other suitable frame materials. For additional strength and stiffness, a longitudinal stiffener 94 may be disposed at the junction of the upright supports 88 and the edge frame extension member 84 as shown.

The modified mattress support system 80 thus provides resilient support in its central portion by virtue of the resilient wire elements 44 and interior wire grid 58, while providing a larger mattress support surface 90, allowing the support of a larger mattress 82. The mattress support system also provides more firm edge support by directly transmitting loads from the edge frame to the base frame, as described above. Being a single unit, the resulting mattress support system 80 is preferably covered with a continuous fabric cover 92, such that the edge frame extension member 84 forms an integral part of the upper section of the mattress support system.

A pictorial view of a complete mattress support system 80 in its finished configuration, with edge frame extensions 84 on its two long sides, is shown in FIG. 1. In this configuration, the upper section 81 of the mattress support system is larger than the base frame 42, such that it may support a mattress of a larger size. For example, a standard queen size mattress has a length of 80 inches and a width of 60 inches. Accordingly, frames to support queen size beds are configured to support a 60 inch wide box spring, and those including a headboard and footboard are sized for an 80 inch long box spring.

However, viewing FIG. 1, the mattress support system of the present invention may be constructed with a base width $W_b$ of 60 inches, while having a top width $W_t$ of 66 inches, provided by edge extensions which extend 3 inches beyond the perimeter of the base frame 42 on each long side. With this configuration, a 66 inch wide mattress may be fully supported to its edge, while using a frame for a standard 60 inch wide queen size bed. The invention thus allows a user to use a larger mattress without the need to purchase additional furniture, etc. to accommodate a larger bed. In the case of a queen size bed frame, it allows the user to have a bed that is larger than a queen size, but smaller than a king size, without buying additional furniture.

It will be apparent that any bed size may be provided with an edge-extended mattress support system to allow the use of a larger mattress, including an extension of the length, whether for larger standard or non-standard sizes. For example, a twin bed may be widened to accommodate a larger mattress, such as a full size. Similarly, a full size bed may be widened and/or lengthened to accommodate a larger mattress such as a queen size. It will also be apparent that only one edge of a mattress support may be extended. For example, a king size bed typically utilizes a pair of twin size box springs disposed side-by-side on a bed frame, to support a single king size mattress. In accordance with the present invention, to support a wider-than-king-size mattress using the same bed frame, one could provide a pair of twin size mattress supports which each having edge frame extensions on one side only.

With this configuration, the edge of the mattress support system essentially does not deflect at all with normal use, thus providing very firm support for the mattress. As with the other embodiments discussed above, the rigidly supported edge frame extension may be provided on any selected portion of the mattress support system, such as around the entire perimeter of the mattress support system, or only on the long sides, etc.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A mattress support system for a bed, said system comprising:

a base section having a rectangular frame comprising a pair of long sides and a pair of short sides with a plurality of transverse members extending between the long sides; and an upper section having an edge frame extension member incorporated therein and being positioned over a side of the base section, said frame extension member being configured to extend laterally outward from an edge of the side to provide the upper section with a larger size than the size of the base section, so that the mattress support system may be supported by a bed frame which corresponds to the size of the base section, and the system fully supports a mattress which corresponds to the larger size of the upper section.

2. The mattress support system of claim 1, wherein the edge frame extension member is rigidly supported by upright supports connected to the base section.

3. A mattress support system according to claim 2, wherein the edge frame extension member is part of an edge frame, the edge frame has a rectangular shape with an intermediate wire support surface extending between members of the edge frame and the system includes a wire support section disposed between the base section and the wire support surface.

4. The mattress support system of claim 1, wherein the upper section of the mattress support system has a first side and a second side extending parallel to the long sides of the base section, and further comprising:

a first edge extension member disposed on the first side of the upper section; and a second edge extension member disposed on the second side of the upper section, said first and second edge extension members extending laterally outward from outer edges of the long sides of the base section.

5. The mattress support system of claim 4, wherein the first edge extension member and the second edge extension member each add at least 3 inches to a side-to-side total width dimension of the mattress support system.

6. The mattress support system of claim 4, wherein the distance from outer edges of the long sides of the/base section is approximately 60 inches, so that the base section of the mattress support system corresponds to the width of a standard queen size bed, while the upper section may support a mattress wider than a standard queen size mattress.

7. The mattress support system of claim 1, wherein the mattress support system has an end, and the edge extension member is disposed on said end.

8. The mattress support system of claim 1, wherein the edge frame extension member comprises an upper bearing surface which is at least 3 inches wide.

9. A mattress support system for a bed, comprising:

a base section having a rectangular frame with a pair of long sides and a pair of short sides with a plurality of transverse members extending between the long sides, said frame having a first size;

a wire support section disposed atop the base section;

an upper section having a substantially rigid perimeter frame having a second size being disposed in the support section, said perimeter frame extending laterally outward from an edge of at least one side of the rectangular frame; and wherein the second size is larger than the first size, such that the mattress support system may be supported by a bed frame which corresponds to the first size of the base section, and the system may support a mattress which corresponds to the second size of the perimeter frame of the upper section, and the edges of said mattress are fully supported by the perimeter frame.

10. The mattress support system of claim 9, wherein the base section has a width, and the second size includes a width which is greater than the width of the base section.

11. The mattress support system of claim 9, wherein the perimeter frame of the upper section is rigidly supported on the base section.

12. The mattress support system of claim 9, wherein the perimeter frame of the upper section is resiliently supported on the base section.

13. A mattress support system for a bed having a mattress, said system comprising:

a base section having a rectangular frame comprising a pair of long sides and a pair of short sides with a plurality of transverse members extending between the long side;

an upper section being unattached to said base section and having a separate substantially rectangular rigid edge frame having an intermediate wire support surface arranged in the edge frame, said edge frame having a substantially planar upper bearing surface for supporting edges of the mattress; and a wire support section disposed between the rectangular frame of the base section and the intermediate wire support surface for holding the upper section spaced from the base section.

14. A mattress support system according to claim 13, which includes upright support members extending between the long sides of the rectangular frame of the base section and the edge frame of the upper section for rigidly supporting the edge frame.

15. A mattress support system according to claim 14, wherein the mattress support system has a perimeter and the edge frame is disposed around said perimeter.

16. A mattress support system according to claim 13, wherein the edge frame is at least three inches wide.

17. A mattress support system according to claim 13, wherein the edge frame comprises elements selected from the group consisting of wood, plastic and metal.

18. A mattress support system according to claim 13, wherein the base section has a perimeter and the edge frame extends outwardly beyond the perimeter of the base section on at least one side of the mattress support system.

19. A mattress support system according to claim 18, wherein the edge frame is a rectangular frame and the system includes upright support members extending between the long sides of the rectangular frame of the base section and the edge frame of the upper section for rigidly supporting the edge frame.

* * * * *